US007681649B2

(12) United States Patent
Cerovsek

(10) Patent No.: US 7,681,649 B2
(45) Date of Patent: Mar. 23, 2010

(54) POWER SLIPS

(75) Inventor: Milan Cerovsek, Calgary (CA)

(73) Assignee: Tesco Corporation, Houston, TX (US)

( * ) Notice: Subject to any disclaimer, the term of this patent is extended or adjusted under 35 U.S.C. 154(b) by 137 days.

(21) Appl. No.: 11/937,220

(22) Filed: Nov. 8, 2007

(65) Prior Publication Data

US 2009/0120649 A1 May 14, 2009

(51) Int. Cl.
*E21B 19/07* (2006.01)

(52) U.S. Cl. ..... 166/382; 166/77.51; 175/423

(58) Field of Classification Search ..... 166/382, 166/77.51–77.53; 175/423
See application file for complete search history.

(56) References Cited

U.S. PATENT DOCUMENTS 2,063,361 A * 12/1936 Baash ..... 175/423
2,298,507 A * 10/1942 Penick et al. ..... 188/67
2,890,513 A * 6/1959 Lane ..... 188/67
3,188,708 A * 6/1965 O'Haver ..... 175/424
4,275,488 A * 6/1981 Gray et al. ..... 294/102.2
4,579,379 A * 4/1986 Berg ..... 294/102.2
4,715,456 A * 12/1987 Poe et al. ..... 175/423
5,848,647 A * 12/1998 Webre et al. ..... 166/379
6,089,338 A * 7/2000 Bouligny, Jr. ..... 175/423
6,640,939 B2 * 11/2003 Buck ..... 188/67
6,892,835 B2 5/2005 Shahin et al.
6,994,176 B2 2/2006 Shahin et al.
7,143,849 B2 12/2006 Shahin et al.
2007/0163807 A1 7/2007 Lutzhoft et al.

OTHER PUBLICATIONS

Composite Catalog, 43rd Ed. 1998-1999, FMS 375 Flush Mounted Casing Slip, five pages including cover page.

* cited by examiner

*Primary Examiner*—Shane Bomar
(74) *Attorney, Agent, or Firm*—Bracewell & Giuliani LLP

(57) ABSTRACT

A slip assembly for gripping pipe during well drilling operations has a housing with a hole for receiving a section of pipe. Pockets in the housing are spaced circumferentially around the hole. Each of the pockets has side walls that face toward each other and are connected to each other by a back wall that has at least one ramp surface. A slip segment is located in each pocket, each slip segment having side edges that engage the side walls of one of the pockets. Each slip segment has a back side with a ramp surface that engages the ramp surface on the back wall of the pocket. Each of the slip segments is movable within its pocket from an upper outward position to a lower inward position in gripping engagement with the pipe.

20 Claims, 7 Drawing Sheets

POWER SLIPS

FIELD OF THE INVENTION

This invention relates in general to power slips used to support pipe during oil and gas well drilling operations.

BACKGROUND OF THE INVENTION

During oil and gas well drilling, at certain depths and at total depth, the operator typically runs and cements a string of casing in the well. The string of casing is made up of sections of pipe, each about 40 feet in length. Each section of pipe has externally threaded ends, one of which has a collar secured to it, the collar having internal threads.

While picking up another section of casing, the operator supports the made-up string of casing in the well with slips at the rig floor. The collar normally has insufficient strength to bear the weight of a lengthy string of casing, thus the slips have to be configured to grip the exterior of the casing below the collar.

Generally the slips comprise a plurality of segments that slide up and down a conical bowl between released and gripping positions. Power slips employing hydraulic cylinders to move the slip segments are commonly employed. Power slips can be mounted to a rotary table at the rig floor. In that instance, as the operator screws the new section of casing to the string of casing supported by the slips, the torque imposed on the string by the make-up mechanism can be transferred through the slips to the rotary table to prevent the string from spinning during make-up. Power slips can also be employed to support a string of drill pipe.

Power slips are also used as elevators. In that instance, they are coupled to elevator bails, which are supported by a lifting mechanism on the drilling rig, such as the blocks or a top drive. When used as elevators, they move up and down the derrick with the lifting mechanism and are used to lift sections of casing to be made up with the made-up string.

SUMMARY

The slips assembly of this invention has a housing containing interior pockets spaced circumferentially around the hole through which the pipe extends. Each pocket has a back wall and two side walls that face each other. At least one ramp surface, and preferably upper and lower ramp surfaces, protrudes inward from the back wall.

A slip segment fits in each pocket and slides between an upper released position and a lower gripping position. The slip segment has mating ramp surfaces on its outer side that slide on the ramp surfaces of the back wall as the slip segment moves between positions. The slip segment has side edges that contact the side walls of the pocket to transfer torque.

A hydraulic cylinder is located between the back wall and outer side of each slip segment to move the slip segment between positions. Preferably a cavity extends vertically through the ramp surfaces to accommodate the hydraulic cylinder. The cavity is centered between the side edges of the segment.

In the preferred embodiment, the housing is formed in two sections that are hinged together. One section preferably has more pockets than the other.

DETAILED DESCRIPTION OF THE INVENTION

Figure 1:
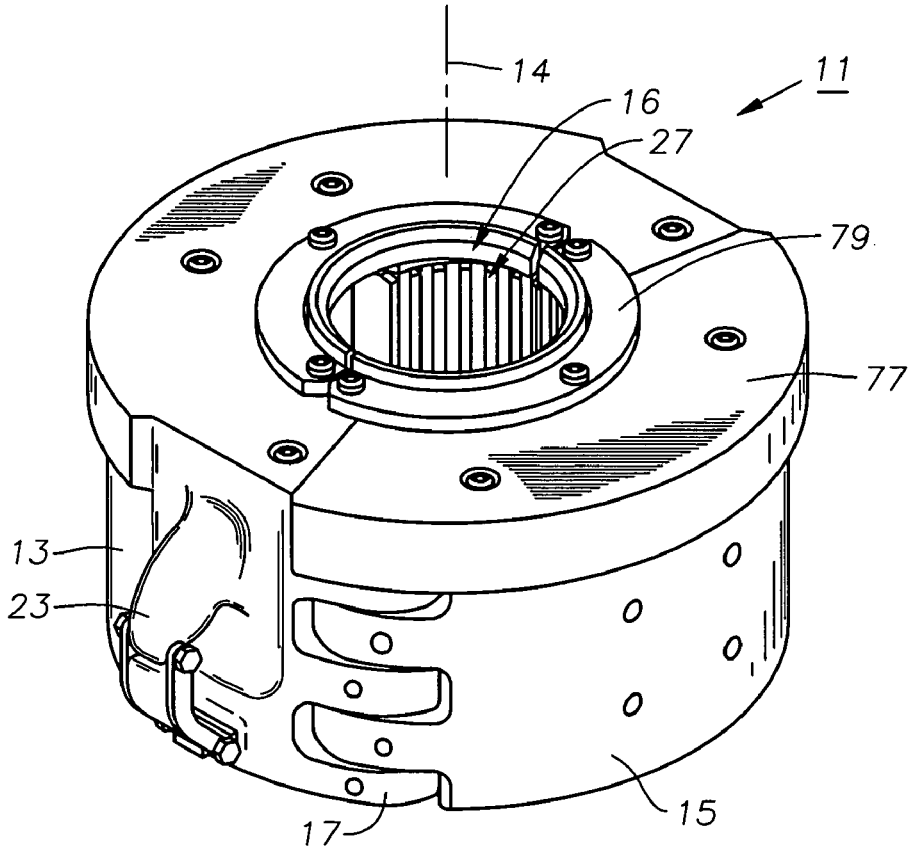
FIG. 1 is an isometric view of a power slips constructed in accordance with this invention.

Referring to FIG. 1, power slips 11 has a housing made up of a larger housing segment 13 that is secured to a smaller housing segment 15 by hinge plates 17. Housing segments 13, 15 define a cylindrical member with a hole 16 extending therethrough along an axis 14. Larger housing segment 13 extends circumferentially a greater amount around axis 14 than smaller housing segment 15. In this example, larger housing segment extends about 240 degrees around axis 14, and smaller housing segment 15 extends about 120 degrees.

Figure 3:
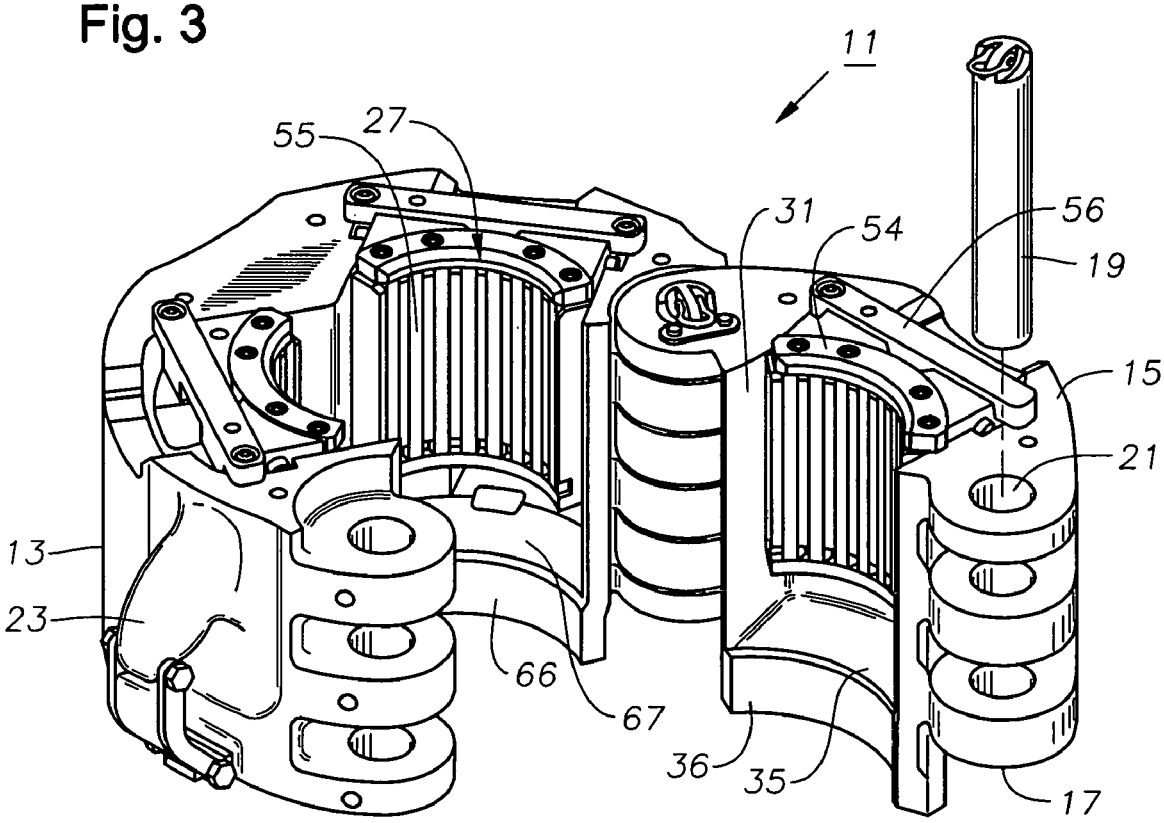
FIG. 3 is an isometric view of the power slips of FIG. 1, shown in an open position and with the top plate and guide plate removed.

As shown also in FIG. 3, each hinge plate 17 is engaged by a pin 19 extending through mating holes 21. Referring again to FIG. 1, in this embodiment, power slips 11 also has a pair of lugs 23 spaced on opposite sides. Lugs 23 are used to connect power slips 11 to elevator bails 25 (FIG. 15) when power slips 11 is used as an elevator.

Figure 2:
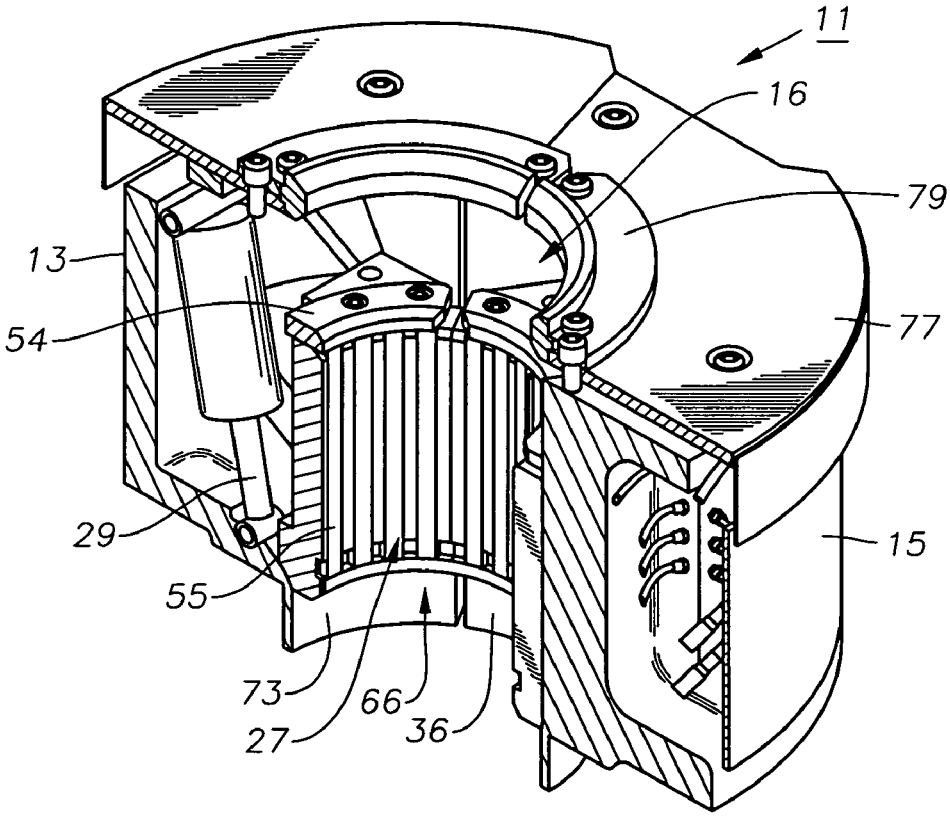
FIG. 2 is an enlarged sectional view of the power slips of FIG. 1, shown in a gripping position.

Referring to FIG. 2, power slips 11 holds a plurality of slip segments 27. In this embodiment, there are three slip segments 27, each extending approximately 120 degrees to form a cylindrical configuration when in the lower gripping position shown in FIGS. 2 and 5, but different numbers could be employed. A hydraulic cylinder 29 for each slip segment 27 is used to move the slip segments 27 between the gripping position shown in FIGS. 2 and 5 and the released position shown in FIG. 4. When moving from the released position of FIG. 4 to the gripping position of FIG. 5, slip segments 27 move downward and inward relative to axis 14 of power slips 11.

Figure 6:
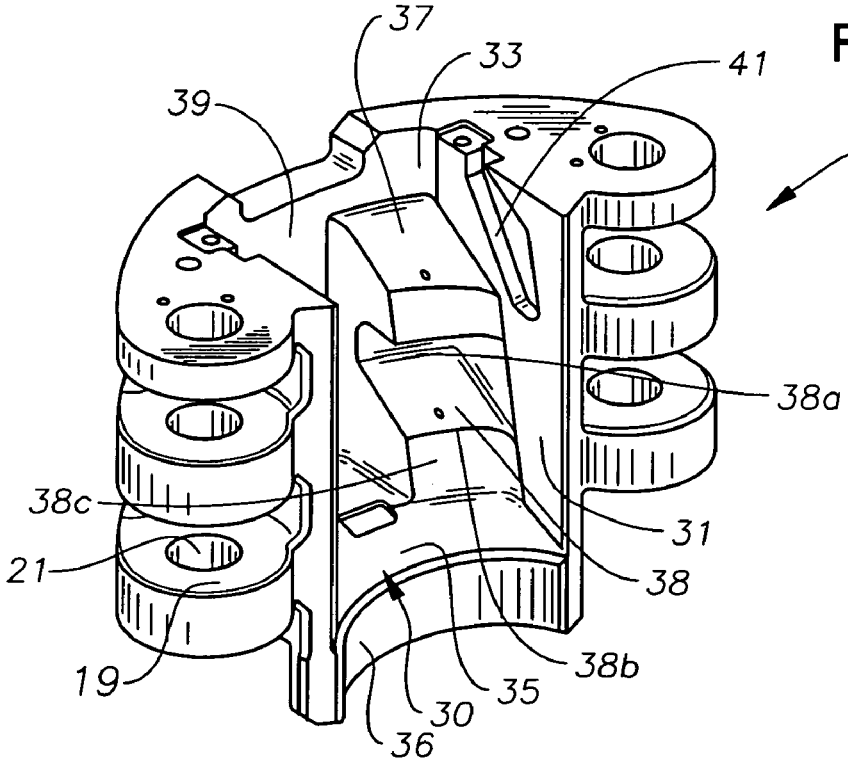
FIG. 6 is an isometric view of the smaller housing segment of the power slips of FIG. 1, with the slips, top plate, and guide plate removed.
Figure 7:
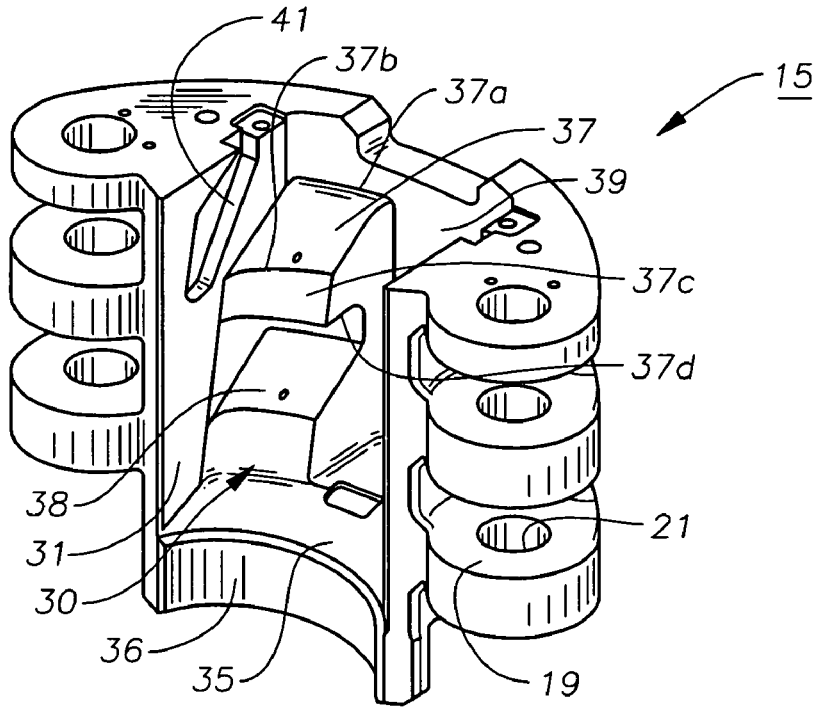
FIG. 7 is an isometric view of the smaller housing segment of FIG. 6, but shown at a different angle.

FIGS. 6 and 7 illustrate smaller housing segment 15 with its slip segment 27 removed. In this example, smaller housing segment 15 has one slip pocket 30, which is defined by a pair of sidewalls 31 that face each other and are flat and parallel in this embodiment. Neither sidewall 31 is on a radial line from axis 14. Sidewalls 31 are joined by a back wall 33 that is a portion of the cylinder. A conical surface 35 located at the bottom of back wall 33 joins the lower edges of sidewalls 31. Conical surface 35 leads downward to a partially cylindrical lip 36 that defines part of the lower end of hole 16 (FIG. 2). Lip 36 extends downward from the lower end of smaller housing segment 15.

Figure 5:
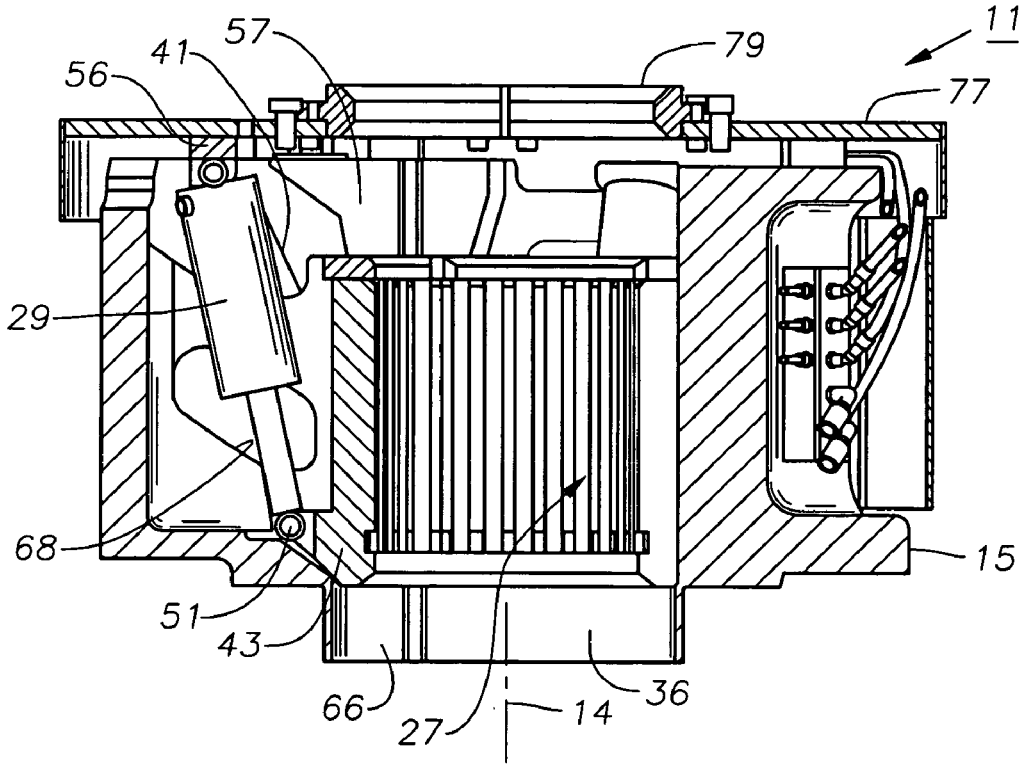
FIG. 5 is a sectional view of the power slips of FIG. 1, shown in a gripping position.

Upper ramp sections 37 are formed integrally on back wall 33 and slope downward and inward. There are two upper ramp sections 37 spaced circumferentially apart by a vertical cavity 39 for accommodating hydraulic cylinder 29 (FIG. 5). There are also two lower ramp sections 38 spaced below upper ramp sections 37 and separated by a lower portion hydraulic cylinder cavity 39. The lower two ramp sections 38 are located above and radially outward from conical surface 35.

Each upper ramp section 37 has a configuration of a tooth, having an upper end 37*a* joining back wall 33 and a lower end 37*b* spaced closer to axis 14 (FIG. 5) of housing segments 13, 15. A lower sloping edge 37*c* extends downward from lower end 37*b* at a steeper angle than the upper surface or flank of upper ramp section 37. Upper ramp section 37 has a lower side 37*d* that is generally perpendicular to axis 14 and extends from lower edge 37*c* to back wall 33.

Each lower ramp section 38 has a similar configuration, with an upper end 38*a* at back wall 33 that is spaced below the junction of upper ramp section lower side 37*d* and back wall 33. Upper end 38*a* of lower ramp section 38 is spaced closer to axis 14 than upper end 37*a* of upper ramp section 37, but farther from axis 14 than lower end 37*b* of upper ramp section 37. Lower end 38*b* of lower ramp section 38 is spaced closer to axis 14 than lower end 37*b* of upper ramp section 37. A sloping inner edge 38*c* extends from lower end 38*b* to conical surface 35 at a steeper degree than the upper surface of lower ramp section 38. Sidewalls 31 extend inward past inner edges 37*c* and 38*c* of ramp surfaces 37, 38 and join lip 36.

Each sidewall 31 has a guide slot 41 formed therein near its upper end. Each guide slot 41 has a lower edge that extends downward and inward toward axis 14.

Figure 8:
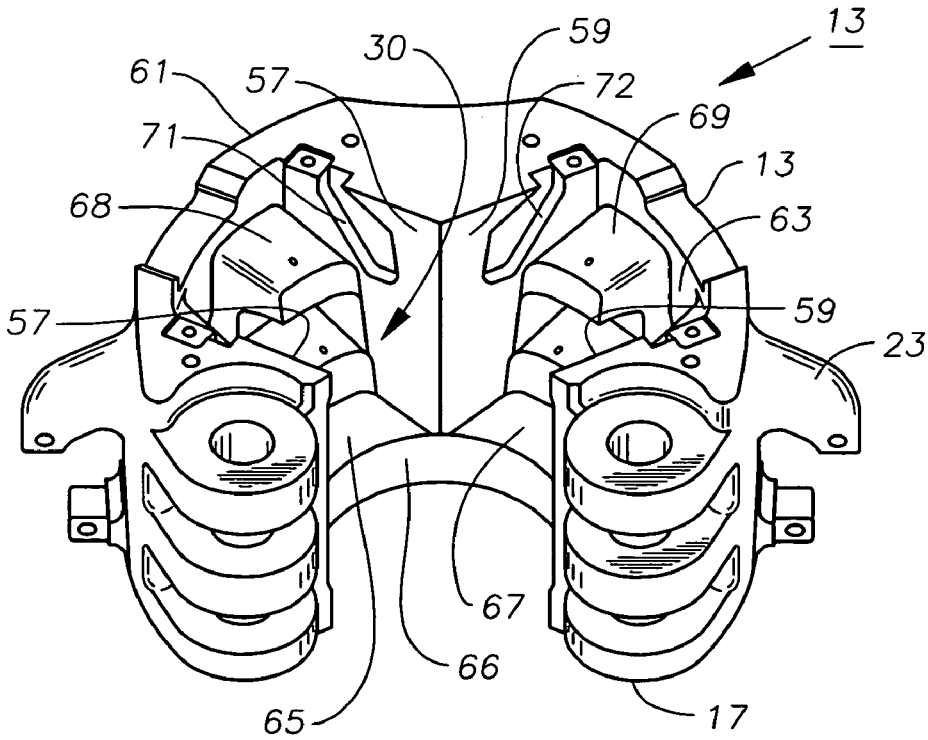
FIG. 8 is an isometric view of the larger housing segment of the power slips of FIG. 1, shown with the slips, top plate and guide plate removed.
Figure 9:
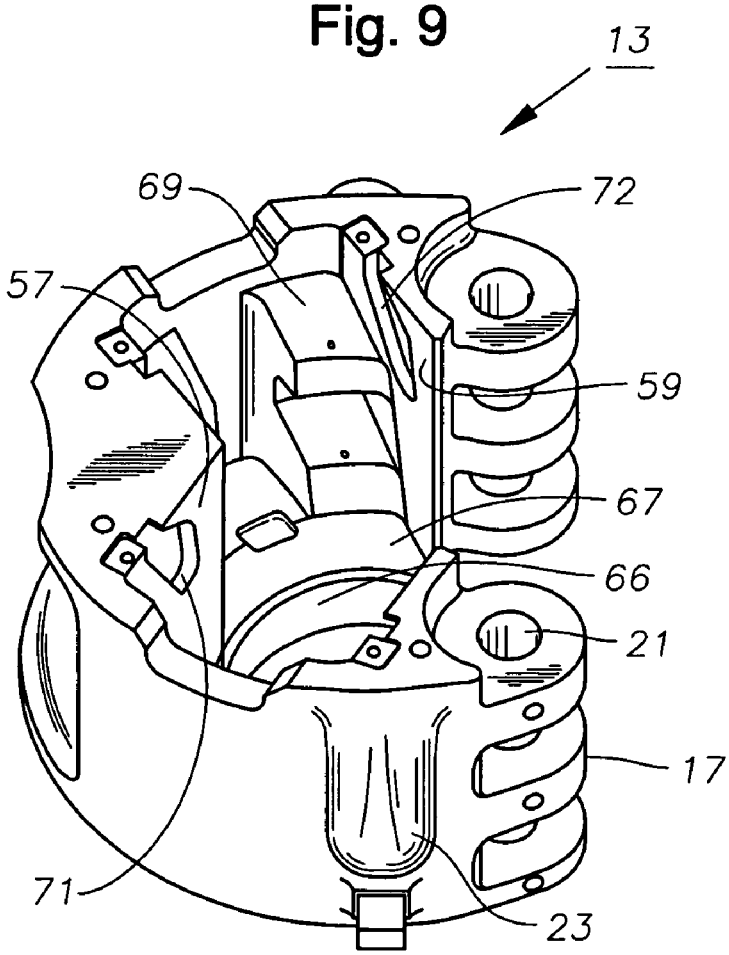
FIG. 9 is an isometric view of the larger housing segment of FIG. 8, but shown at a different angle.
Figure 11:
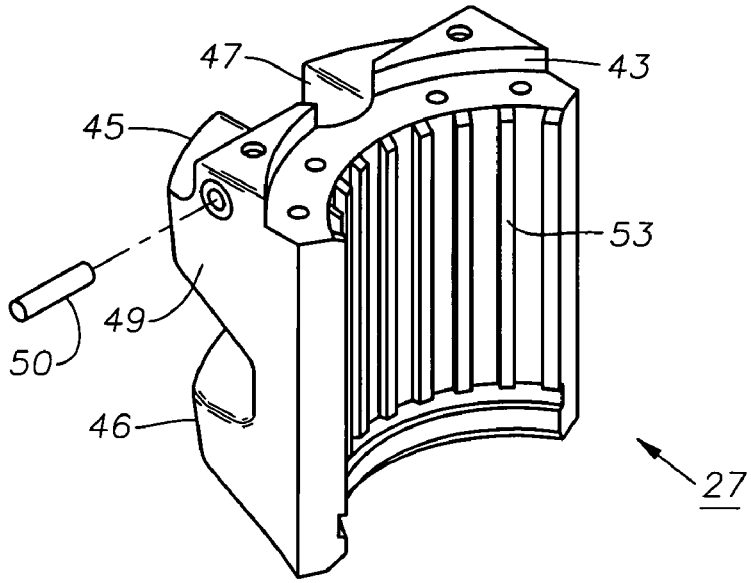
FIG. 11 is an isometric view of one of the slip segments, shown apart from the power slips and with the adapter removed.
Figure 12:
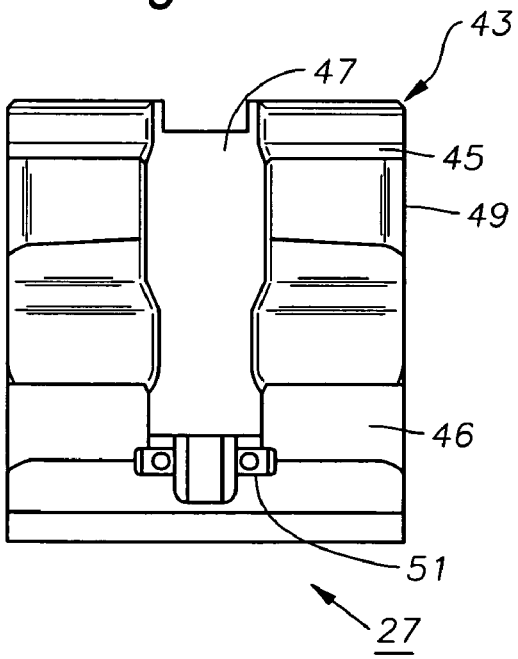
FIG. 12 is an elevational view of the back side of the slip segment of FIG. 11.

Referring to FIG. 11, each slip segment 27 has a slip body 43 dimensioned for reception within one of the slip pockets 30 (FIG. 6) of smaller housing segment 15 as well as one of the slip pockets 30 of larger housing segment 13 (FIG. 8). Slip segment body 43 has side edges 49 that fit closely within side walls 31 of slip pocket 30 (FIG. 6). Slip segment body 43 has upper and lower ramp surfaces 45, 46 on its back side, each of which mates with and slides on one of the ramp sections 37, 38 (FIG. 6) of smaller housing segment 15. As shown in FIG. 12, upper ramp surfaces 45 are circumferentially spaced apart from each other, defining a hydraulic cylinder space 47 that registers with hydraulic cylinder space 39 in FIG. 6. Similarly, lower body ramp surfaces 46 are circumferentially spaced apart from each other. Body ramp surfaces 45, 46 have toothed configurations similar to upper and lower ramp surfaces 37, 38 (FIG. 6) in housing segment 15.

A guide pin 50 is attached to each side edge 49 for reception in one of the guide slots 41 in slip pocket side walls 31 (FIG. 6). Referring to FIG. 12, mounting pins 51 are mounted on the back of slip segment body 43 near its lower end for supporting the lower end of one of the hydraulic cylinders 29 (FIG. 5). The front or inner side of slip segment body 43 is a segment of a cylinder and may have axially extending splines 53 or other gripping members on its forward side.

For some sizes of pipe, splines 53 serve to grip the pipe. For other pipe sizes, an adapter plate 55 (FIG. 13) mounts to the front side of slip segment body 43 over splines 53. Adapter plate 55 is partially cylindrical. The forward or inner side of adapter plate 55 has gripping elements or a gripping surface for engaging a pipe. A flange 54 at the upper edge of adapter plate 55 extends radially outward for securing to the upper edge of slip segment body 43. The thickness of adapter plate 55 is selected to engage various sizes of pipe. Adapter plates 55 of greater and lesser thickness can be interchangeably mounted to slip segment body 43 (FIG. 11) for different pipe diameter sizes.

Figure 4:
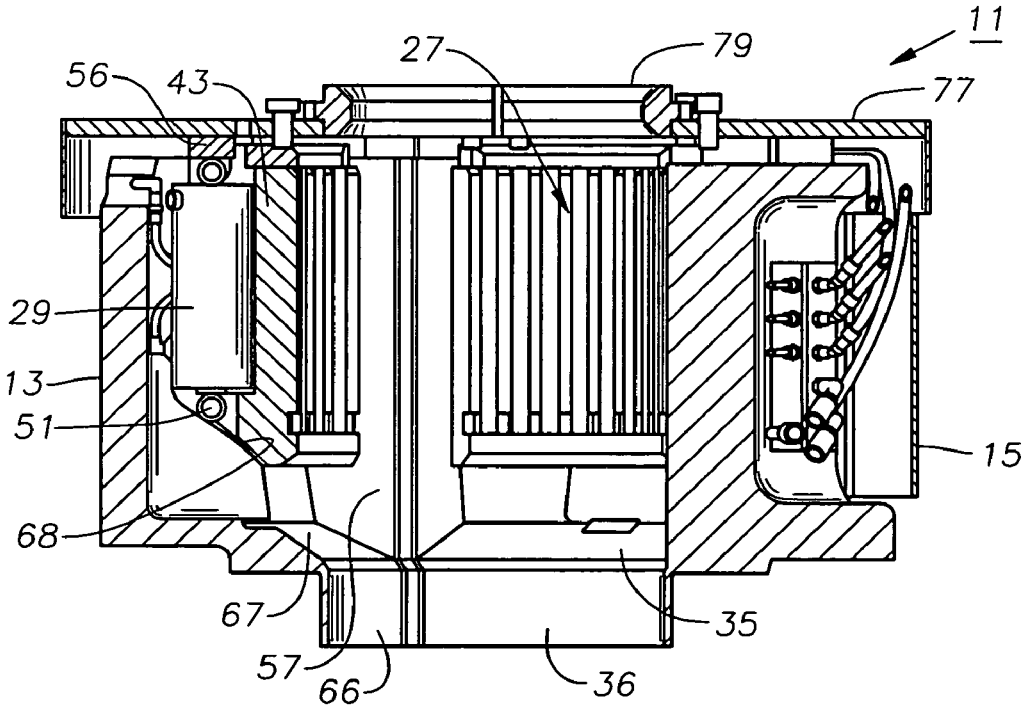
FIG. 4 is a sectional view of the power slips of FIG. 1, shown in a released position.

FIG. 3 shows slip segment body 43 and adapter plate 55 mounted in smaller housing segment 15. A retainer brace 56 bolts to the top of smaller housing segment 15 across the upper end of slip segment body 43 to retain slip segment body 43 in housing segment 15. Retainer 56 has a mounting member that secures the upper end of hydraulic cylinder 29, as shown in FIG. 4. Hydraulic cylinder 29 locates in the mating hydraulic cylinder spaces 39 (FIG. 6) and 47 (FIG. 11), thus, is centered between the side edges of slip segment 27.

When hydraulic fluid is supplied in the extending direction, the shaft end of hydraulic cylinder 29 extends and swings inwardly as shown by comparing FIG. 4 to FIG. 5. Slip body ramp segments 45, 46 slide down ramp sections 37, 38. Guide pins 50 (FIG. 11) at the upper end of slip segment body 43 slide down guide slots 41 (FIG. 6). A flow divider (not shown) in the hydraulic circuitry directs fluid to the three cylinders 29 equally in the extending direction. The flow divider assures that the slip segments 27 move simultaneously to the gripping position, thereby centering the pipe.

Larger housing segment 13, shown in FIG. 8, is constructed in a similar manner, but it holds two of the slip segments 27 (FIG. 3) rather than one in this example. Larger housing segment 13 has two sidewalls 57 that are opposed and parallel to each other to define one of the slip pockets 30. There are also two sidewalls 59 that are opposed and parallel to each other to define the other slip pocket 30. One of the sidewalls 57 and one of the sidewalls 59 intersect each other at their inner edges to form an external corner. In this embodiment, the angle is greater than 90 degrees and is shown to be 120 degrees; the angle could vary. A back wall 61, which is a portion of a cylinder, joins the two sidewalls 57 to define one of the slip pockets 30. Another back wall 63, which is another portion of the same cylinder, and joins the two sidewalls 59 to define the other slip pocket 30. A conical surface 65 is located at the lower end of back wall 61 and extends between the lower ends of sidewalls 57. A conical surface 67 is located at the lower end of back wall 63 and extends between sidewalls 59. A partially cylindrical lip 66 extends downward from conical surfaces 65, 67 to mate with lip 36 (FIG. 6) and define a circular lower end for hole 16 (FIG. 2).

Figure 13:
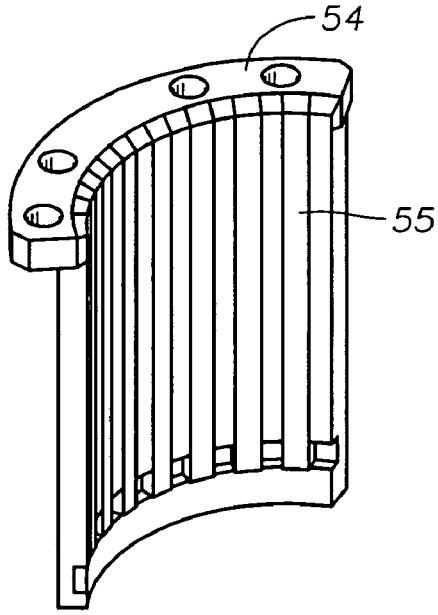
FIG. 13 is an isometric view of an adapter plate for the slip segment of FIG. 11.

Upper and lower ramp sections 68 extend from back wall 61. Upper ramp sections 68 and lower ramp sections 68 are circumferentially spaced apart from each other in the same manner as ramp sections 37 of FIG. 6 to provide a space for one of the hydraulic cylinders 29 (FIG. 2). Similarly, upper and lower ramp sections 69 protrude inward from back wall 63. Guide slots 71 are located in each sidewall 57, and guide slots 72 are located in each sidewall 59. Slip segments 27 as shown in FIGS. 11-13 are mounted in the two pockets 30 of larger housing segment 13. Slip segments 27 in larger housing segment 13 are interchangeable with the one in smaller housing segment 15.

Figure 10:
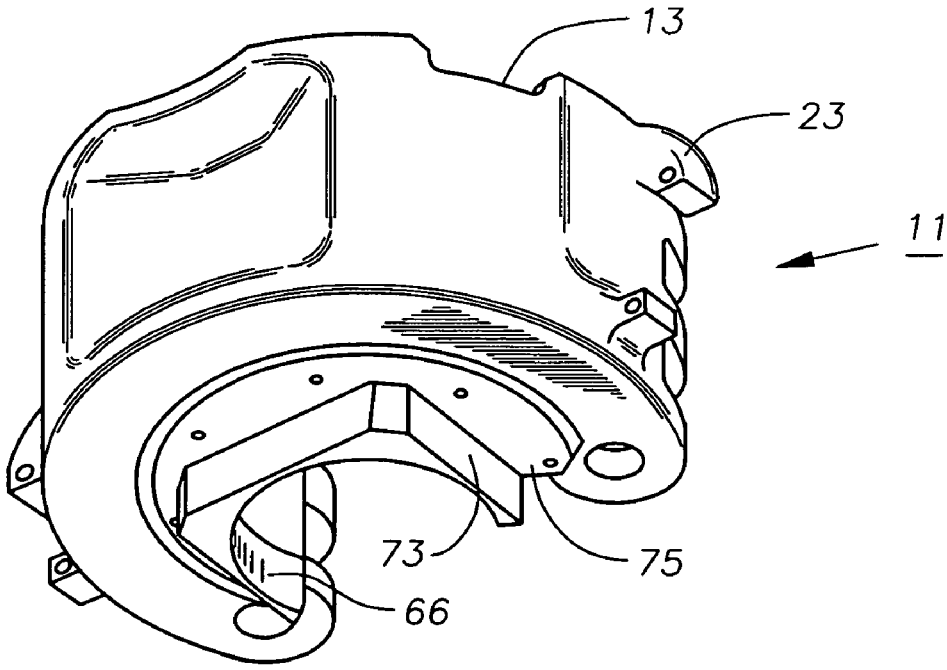
FIG. 10 is another isometric view of the larger housing segment of FIG. 8, but at a different angle.

Referring to FIG. 10, lip 66, which has a circular inner side, has three flat external sides 73. The three flat exterior surfaces 73 define a generally orthogonal configuration that is sized to fit within a rectangular receptacle (not shown) of a rotary table on a drilling rig floor. Lip 66 extends approximately 240 degrees, with the remaining 120 degree portion being open so that it may be placed around pipe when power slips 11 are hinged open as shown in FIG. 3 Rectangular sides 73 lock power slips 11 to the rotary table, preventing rotation of power slips 11 unless the rotary table is rotated, in which case, it rotates with the rotary table. Adapters (not shown) can be mounted to lip 66 around rectangular sides for different sizes and configurations of rotary tables.

Referring to FIGS. 1 and 2, each housing segment 13 and 15 has a top plate 77 that mounts over retainer braces 56 FIG. 3). The top plate 77 on smaller housing segment 15 covers only smaller housing segment 15, extending approximately 120 degrees. The top plate 77 on larger housing segment 13 covers larger housing segment 13, extending approximately 240 degrees. A two-piece top guide 79 is mounted on top plates 77 to define a circular opening for receiving pipe. Top guide 79 may be replaced with top guides of different inner diameters for different pipe sizes. In this example, each of the two pieces of top guide 79 is identical and extends 180 degrees.

Figure 14:
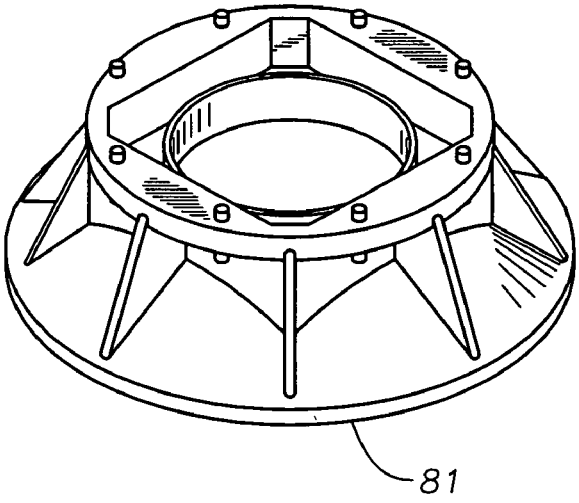
FIG. 14 is an isometric view of a bell guide for attachment to the power slips of FIG. 1 when used as an elevator.
Figure 15:
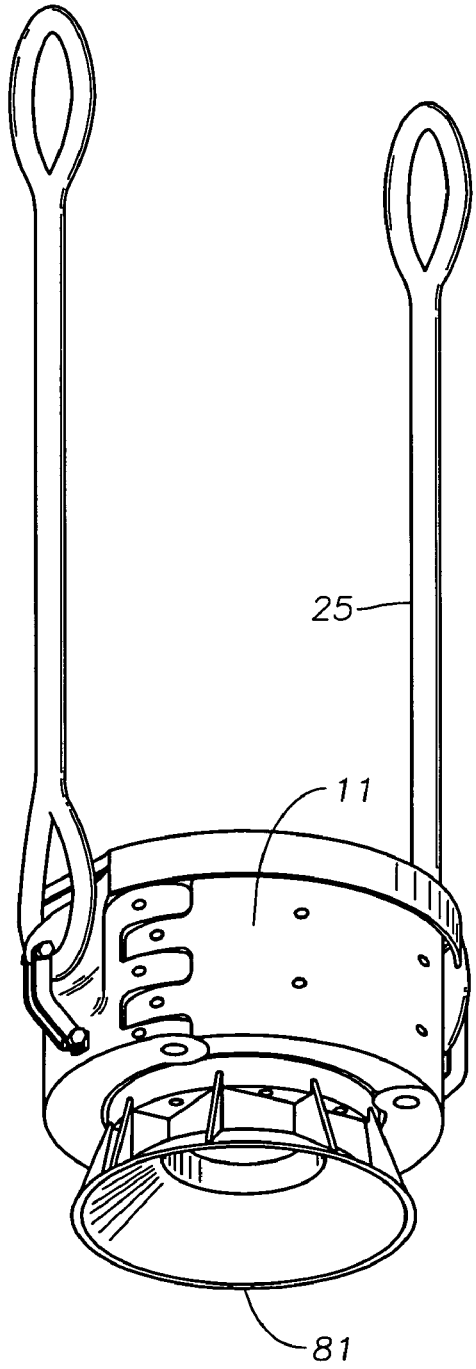
FIG. 15 is a perspective view of the power slips of FIG. 1, shown attached to elevator bails and with the bell guide of FIG. 14 attached.

Referring to FIGS. 14 and 15, power slips 11 can also be used as an drilling rig elevator by mounting it to elevator bails 25. When attached as shown in FIG. 15, power slips 11 move up and down the derrick, being lifted by the lifting mechanism such as the rig blocks or a top drive. When used as an elevator, the operator may employ a bell guide 81 on the lower end to assist in guiding power slips 11 over pipe. Bell guide 81 fastens to the bottom of the assembled housing segments 13, 15 with fasteners engaging threaded holes 75 (FIG. 10).

During operation, the operator will configure power slips 11 for a desired diameter and desired operation. For example, if to be used on the rig floor, the operator will insert lip 66 into the receptacle of the rotary table such that its orthogonal sides 73 (FIG. 10) mate with the receptacle. If a different pipe diameter is to be run, the operator will remove top guide 79, top plates 77 (FIG. 2) and adapter plates 55 (FIG. 3 and FIG. 13). Removing these components provides ready access to adapter plates 55. The operator can remove the current adapter plates 55 and install the desired size of adapter plates 55 without removing any other components. This could be done while power slips 11 are assembled in the cylindrical configuration of FIG. 1. Also removing top guide 79 and top plates 77 exposes pins 19 (FIG. 3), so that the operator can remove one to open smaller housing segment 15. Opening housing segment 15 allows the operator to remove power slips 11 from the rig floor even if pipe is extending through the rotary table and suspended by a lifting mechanism in the derrick.

The operator will control the gripping and releasing movement of power slips 11 remotely. To cause slip segments 27 to move to the gripping position of FIG. 5 from the released position of FIG. 4, the operator supplies hydraulic fluid to hydraulic cylinders 29. Each hydraulic cylinder 29 moves one of the slip segments 27 downward and inward along the various ramp sections 37, 38, 68 and 69. When in the lowest position, a lower portion of each slip segment 27 will contact one of the conical surfaces 35 (FIG. 6), 65 or 67 (FIG. 8). While gripping the pipe, if torque is applied, the force passes through slip segments 27 to the sidewalls of the pockets 30. When hydraulic fluid is supplied in the reverse direction to hydraulic cylinders 29, they pull slip segments 27 upward and outward to the position shown in FIG. 4. In the fully released position shown in FIG. 4, slip segments 27 are spaced above conical surfaces 35, 65 and 67.

The power slip assembly described has significant advantages. The slip pockets retain the slip segments to resists torque and allow the slip segments to readily move between griping and released positions. The uses of upper and lower toothed-shaped ramp surfaces in each pocket makes the unit compact. Making one of the housing segments circumferentially smaller than the other allows one to utilize fewer slip segments than if the housing segments were equal in size. The arrangement of the slips and adapter plates allows the operator to easily change the adapters for different pipe diameters merely by removing the top guide and top plates.

While the invention has been shown in only one of its forms, it should be apparent to those skilled in the art that it is not so limited but is susceptible to various changes without departing from the scope of the invention.

The invention claimed is:

1. A slips assembly for gripping pipe, comprising:

first and second housing segments that arc secured to each other by a hinge, defining a housing having a hole therethrough for receiving a section of pipe;

a plurality of pockets in the housing and spaced circumferentially around the hole, the pockets and the housing being movable in unison with each other, each of the pockets having two circumferentially spaced apart side walls that face toward each other, me side walls being connected to each other by a circumferentially extending back wall that has at least one ramp surface;

a slip segment located in each pocket, each slip segment having side edges on opposite circumferential sides of the slip segment, at least one of the side edges contacting one of the side walls of one of the pockets in operation to transfer torque between the slip segments and the housing, and each of the slip segments having a circumferentially extending back side with at least one ramp surface that engages the ramp surface on the back wall of the pocket; and each of the slip segments being slidable on the ramp surfaces within its pocket from an upper outward position to a lower inward position in gripping engagement with the pipe.

2. The assembly according to claim 1, wherein the side walls of each pocket are flat and substantially parallel to each other.

3. The assembly according to claim 1, wherein:

said at least one ramp surface on each of the back walls comprises upper and lower ramp surfaces on each the back walls; and said at least one ramp surface on each of the back sides comprises upper and lower ramp surfaces on each the back sides.

4. The assembly according to claim 1, wherein:

said at least one ramp surface on each of the back walls comprises a pair of side-by-side rain p surfaces on each of the back walls, the pair of ramp surfaces within each pocket being circumferentially separated from each other by a vertical cavity; and wherein the assembly further comprises:

a hydraulic cylinder mounted in each of the cavities and connected to one of the slip segments for moving the slip segment between the upper outward and lower inward positions.

5. The assembly according to claim 1 wherein:

said at least one ramp surface on each of the back walls comprises upper and lower ramp surfaces on each of the back walls, each of the upper and lower ramp surfaces having an upper end and a lower end; and the upper end of the upper ramp surface being spaced farther from an axis or the hole than the upper end of the lower ramp surface, the upper end of the lower ramp surface being spaced farther from the axis than the lower end of the upper ramp surface, and the lower end of the lower ramp surface being spaced farther from the axis than the lower end of the upper ramp surface.

6. The assembly according to claim 1, wherein:

the first housing segment contains more of the pockets than the second segment.

7. The assembly according to claim 6, wherein:

the first housing segment contains at least two pockets.

8. The assembly according to claim 1, wherein each of the slip segments comprises:

a slip body;

an adapter plate mounted to an inner side of the slip body, the adapter plate having an inner side having a gripping surface; and the adapter plate having an upper end containing a f1ange extending therefrom, the flange overlying and engaging an upper portion of the slip body.

9. The assembly according to claim 1, further comprising:

an elongated guide slot formed in each of the side walls of each of the pockets; and a guide pin rigidly mounted to each side edge of each of the slip segments and in sliding engagement with one of the guide slots.

10. The assembly according to claim 1, wherein one of the side walls of one of the pockets has an inner edge that intersects an inner edge of one of the side walls of an adjacent pocket, forming a corner protruding inward toward the axis.

11. A slips assembly for gripping pipe, comprising:

first and second housing segments that are secured to each other by a hinge, defining a housing having a hole therethrough for receiving a section of pipe;

a plurality of pockets in the housing and spaced circumferentially around the hole, each of the pockets being movable in unison with the housing, each of the pockets having an upper end, a lower end, and side walls that are flat, parallel to each other and connected to each other by a back wall that extends circumferentially between the side walls, the side walls extending from the lower end to the upper end of the pocket;

at least one upper ramp surface on the back wall of each of the pockets, the upper ramp surface sloping inward and downward toward an axis of the hole;

at least one lower ramp surface on the back wall of each of the pockets below the upper ramp surface, the lower ramp surface sloping inward and downward toward the axis, the lower ramp surface having an upper end that is closer to the axis than an upper end of the upper ramp surface and farther from the axis than a lower end of the upper ramp surface, the lower ramp surface having a lower end that is closer to the axis than the lower end of the upper ramp surface;

a slip segment located in each pocket, each slip segment having side edges, at least one of the side edges of each of the slip segments contacting one of the side walls of the pocket during operation to transfer torque between the slip segments and the housing;

upper and lower ramp surfaces on a back side of each of the slip segments that engage the upper and lower ramp surfaces on the back wall of the pocket; and the ramp surfaces of each of the slip segments being slidable along the upper and lower ramp surfaces of the back wall within its pocket from an upper outward position to a lower inward position in gripping engagement with the pipe.

12. The assembly according to claim 11, further comprising:

a vertically extending cavity extending through the upper ramp surface and the lower ramp surface on each of the back walls and through the upper ramp surface and the lower ramp surface on each of the slip segments; and a hydraulic cylinder mounted in each of the cavities and connected to one of the slip segments equidistant between the side edges of the slip segment for moving the slip segment between the upper outward and lower inward positions.

13. The assembly according to claim 11, wherein:

the first housing segment contains at least two of the pockets; and the second segment contains fewer of the pockets than the first housing segment.

14. The assembly according to claim 11, wherein each of the slip segments comprises:

a s1ip body having an inner side that is partially cylindrical;

an adapter mounted to the inner side of the slip body, the adapter having an inner side having a gripping surface; and a flange extending outward from an upper end of the adapter into overlying engagement with an upper end of the slip body.

15. The assembly according to claim 11, further comprising:

an elongated guide slot formed in each of the side walls of each of the pockets; and a guide pin rigidly mounted to each side edge of each of the slip segments and in sliding engagement with one of the guide slots.

16. The assembly according to claim 11, wherein one of the side walls of one of the pockets has an inner edge that intersects an inner edge of one of the side walls of an adjacent pocket at an angle greater than 90 degrees, forming a corner protruding inward toward the axis.

17. A method of gripping a first pipe and subsequently a second pipe of a different diameter than the first pipe, comprising:

(a) providing a slips housing and mounting a plurality of slip segments therein, each slip segment having a slip body and a first adapter plate mounted thereon, and mounting a top plate on the slips housing over at least a portion of each first adapter plate;

(b) extending the first pipe through the top plate and slips housing, then moving the slip segments downward and inward relative to the housing into gripping engagement with the first pipe; then, to grip the second pipe after removal of the first pipe from the housing, (c) removing the top plate to provide access to the first adapter plates, then removing the first adapter plates from the slip bodies and securing second adapter plates to the slip bodies while the slip bodies remain mounted in the housing, then re-attaching the top plate to the housing over at least a portion of the second adapter plates; then (d) extending the second pipe through the top plate and slips housing, then moving the slip segments downward and inward into gripping engagement with the second pipe.

18. The method according to claim 17, wherein the second pipe has a smaller diameter than the first pipe, and the second adapter plates are thicker than the first adapter plates.

19. The method according to claim 17, wherein:

step (b) further comprises mounting the slips housing on a rotary table of a well drilling rig; and step (c) occurs while the slips housing remains mounted on the rotary table.

20. The method according to claim 19, wherein:

step (a) further comprises mounting a first top guide on the top plate; and step (c) comprises removing the first top guide and after re-attaching the top plate, mounting a second top guide on the top plate, the second top guide having a different inner diameter than the first top guide.

* * * * *